United States Patent [19]

Greene

[11] Patent Number: 4,674,135

[45] Date of Patent: Jun. 23, 1987

[54] DISPOSABLE UNDERGARMENT

[76] Inventor: Joy W. Greene, 17157 Beaver Springs, Houston, Tex. 77090

[21] Appl. No.: 828,868

[22] Filed: Feb. 12, 1986

[51] Int. Cl.[4] ..... A41B 9/00; B65D 81/28

[52] U.S. Cl. ..... 2/400; 2/402; 2/406; 604/385 R; 206/213

[58] Field of Search ..... 2/400, 402, 406, 407, 2/243 B; 206/213, 581; 604/385.1, 385.2

[56] References Cited

U.S. PATENT DOCUMENTS

| | | | |
|---|---|---|---|
| 3,237,625 | 3/1966 | Johnson | 2/406 X |
| 3,424,162 | 1/1969 | Parravicini | 2/400 X |
| 3,488,778 | 1/1970 | Goujon et al. | 2/402 |
| 3,636,953 | 1/1972 | Benevento | 2/402 X |
| 4,031,568 | 6/1977 | Huff | 2/402 X |
| 4,430,087 | 2/1984 | Azpiri | 604/385.1 |

FOREIGN PATENT DOCUMENTS

| | | | |
|---|---|---|---|
| 1198902 | 7/1970 | United Kingdom | 2/402 |

*Primary Examiner*—Harvey C. Hornsby
*Assistant Examiner*—J. L. Olds
*Attorney, Agent, or Firm*—Kenneth A. Roddy

[57] ABSTRACT

A disposable undergarment is formed of a single sheet of non-woven cellulose material such as paper. The material is cut into a generally hour-glass shape defining a front portion, back portion, intermediate crotch portion, two generally semicircular opposed cut-outs at each side of the material, a detachable crotch insert portion formed within one of the opposed cut-outs, and may include a detachable circular container portion formed within one of the opposed cut-outs and adjoined to the front portion. The crotch insert is secured to the intermediate crotch portion in superposed relation forming a double ply crotch area. The front and back portions are secured together at their sides to form a main body portion having a pair of leg openings and a waist portion at the top thereof. The outer edges of the leg openings and side edges of the crotch insert are folded over and sewn along the fold with elastic thread or rubber band elastic to form a stretchable elastic hem about the leg openings. The top edge of the waist portion is folded over and sewn along the fold with elastic thread or rubber band elastic to form a stretchable elastic waist band hem. The container portion is stitched along its peripheral edge with elastic thread to form a pouch having a stretchable elastic opening at the top, and capable of receiving the undergarment in a rolled or folded condition. The pouch is detached prior to use by the wearer for receiving and storing the undergarment in a rolled or folded condition after being worn, and disposed of at the convenience of the wearer.

14 Claims, 5 Drawing Figures

DISPOSABLE UNDERGARMENT

BACKGROUND OF THE INVENTION

1. Field of the Invention

This invention relates generally to disposable undergarments, and more particularly to a disposable undergarment formed from a single sheet of material and which has a crotch insert and a built in container pouch for carrying and disposing of the undergarment after use and the method of manufacture.

2. Brief Description of the Prior Art

Disposable undergarments are known in the art. Most are directed toward baby diapers having absorbant liners and moisture proof leg and waist bands, padded undergarments for use in hospitals for incontinent bedridden patients, and hygienic panties having absorbant pads for menstrual use, incontinence, etc,. Most disposable undergarments of the aforementioned type are bulky and require a large box or bag for carrying and are not lightweight or comfortable or otherwise suitable for every day use.

There are several patents which disclose various disposable undergarments.

Karami et al, U.S. Pat. No. 4,427,408 discloses a multilayer disposable diaper comprising an impervious backing sheet, a facing sheet and a pair of absorbent pads placed between the sheets. The facing sheet is bonded to the backing sheet about its periphery and between the pads to form front and back panels which have their free ends bonded together. The waist band is formed by two elasticised strips bonded along the sides of the panels.

Repke et al, U.S. Pat. No. 4,205,679 discloses a multilayer, disposable undergarment for use in training infants or by incontinent adults formed of non-woven stretchable material. The undergarment has a stretchable moisture-pervious fabric inner layer, a stretchable moisture-impervious outer layer, and an intermediate liquid absorbant panel disposed therebetween.

Anderson et al, U.S. Pat. No. 3,648,699 discloses a disposable garment for incontinent bedridden patients. The garment comprises an outer piece having short leg portions and a waist encircling portion, and an inner piece of moisture proof sheet material corresponding to the outline of the outer piece. The inner piece is insertable and removable from the outer piece, and has a layer of moisture absorbent material on one side which contacts the body of the wearer.

Larson, U.S. Pat. No. 3,599,640 discloses a disposable undergarment formed of a single sheet of non-woven fabric such as paper with thermoplastic material incorporated therein. The waist encircling portion is heat crimped in V-shaped corrugations to provide elasticity and stretch to the fabric and the side seams are heat fused together by melting the thermoplastic material.

Parravicini, U.S. Pat. No. 3,424,162 discloses a disposable hygenic panty comprising front and rear panels of single layer non-woven cellulose material sewn together to form a waist portion and a body portion with leg openings. The waist band is formed by cloth strip sewn to the waist portion, and a cloth strip is sewn along the leg openings for reinforcing the edge of the material. Elastic bands are sewn into the cloth strips. A cotton gauze insert may be sewn into the crotch portion, or the panty may be completely lined with gauze.

The present invention is distinguished over the prior art in general, and these patents in particular, by a disposable undergarment made from a single sheet of material which has a crotch insert and container pouch which are initially part of the undergarment. The pouch is detached prior to use by the wearer for receiving and storing the undergarment in a rolled or folded condition after being worn, and disposed of at the convenience of the wearer.

SUMMARY OF THE INVENTION

It is therefore an object of the present invention to provide a disposable undergarment which is inexpensive in construction and manufacture and which can be thrown away after use.

It is another object of this invention to provide a disposable undergarment which inexpensively constructed of non-woven cellulose material which is attractive, soft, lightweight, comfortable, and durable in use.

Another object of this invention is to provide a disposable undergarment having a small container pouch initially attached which may be detached prior to use by the wearer for receiving and storing the undergarment in a rolled or folded condition after being worn, and disposed of at the convenience of the wearer.

Another object of this invention is to provide a disposable undergarment which may be rolled or folded in a very small configuration to be packaged in very small containers suitable for use in vending machines in airports, restrooms, and other locations.

Another object of this invention is to provide a disposable undergarment which is suitable for every day use, and particularly useful for travelers and vacationers.

A further object of this invention is to provide a disposable undergarment which occupies a very small space in its stored condition and will fit conveniently in a purse, pocket or suitcase.

Other objects of the invention will become apparent from time to time throughout the specification and claims as hereinafter related.

The above noted objects and other objects of the invention are accomplished by an attractive, lightweight, disposable undergarment made from a single sheet of paper-like material having a crotch insert and container pouch which are initially part of the undergarment. The pouch is detached prior to use by the wearer for receiving and storing the undergarment in a rolled or folded condition after being worn, and disposed of at the convenience of the wearer.

DESCRIPTION OF THE PREFERRED EMBODIMENT

Figure 1:
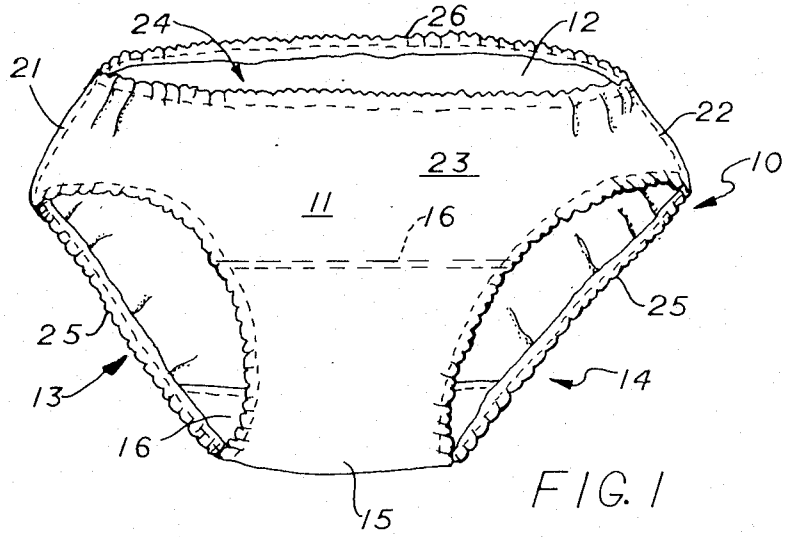
FIG. 1 is a front view of the disposable undergarment in the form of lady's bikini underwear as it would be worn.
Figure 2:
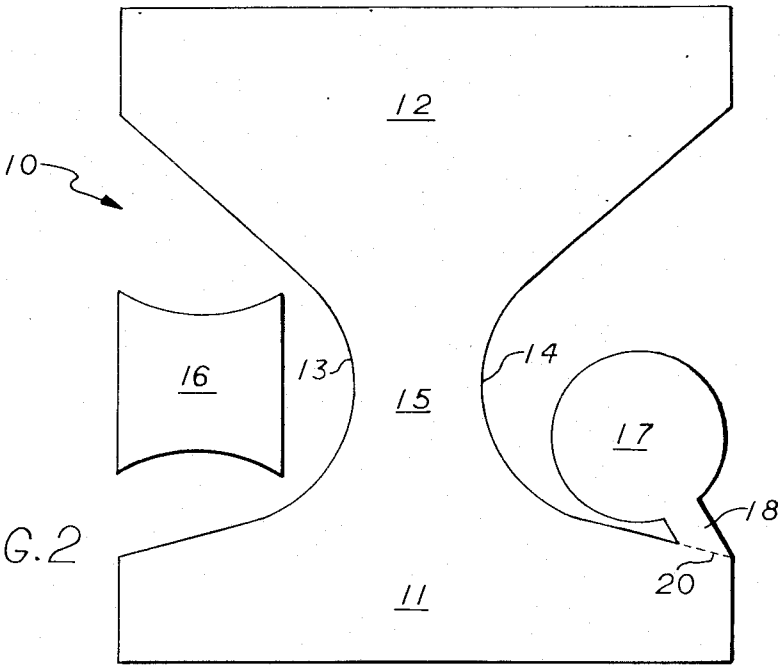
FIG. 2 is a plan view of the garment of FIG. 1 after cutting and before assembly.
Figure 3:
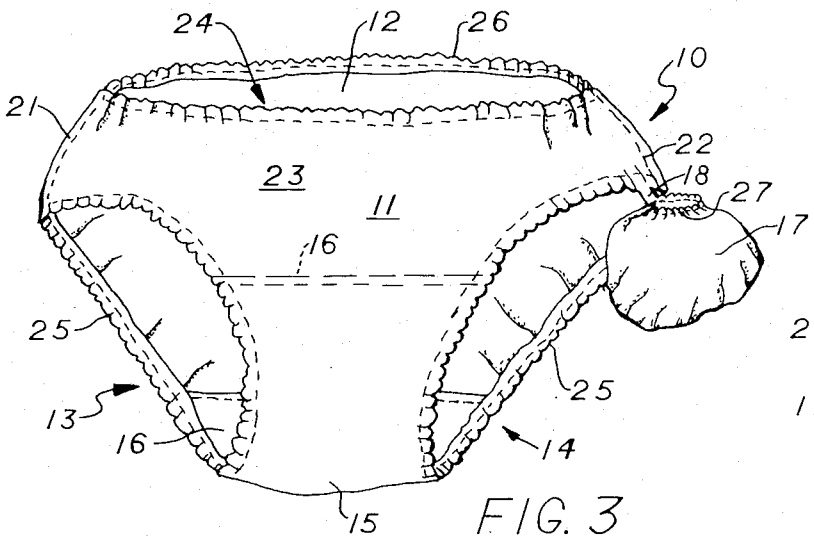
FIG. 3 is a front view of the garment of FIG. 1 after assembly with the container pouch still attached.

Referring to the drawings by numerals of reference, there is shown in FIG. 1, a disposable undergarment 10 in the form of a lady's bikini panty. The undergarment 10 is formed from a single piece of material die-cut in a generally hourglass configuration shown in FIG. 2 to form a front portion 11 and a back portion 12 with two generally semi-circular cut-outs situated on each side of the longitudinal center line of the material, as shown at 13 and 14, to form the leg openings, and an intermediate region of the material forms a crotch portion 15. A generally rectangular crotch insert portion 16 having two curved sides and a circular container portion 17 is die-cut at the same time, or by subsequent operation.

The crotch insert 16 and the container portion 17 are integral with the single piece of material of the undergarment and are formed within one of the leg opening cut-outs at either side. The container portion 17 is adjoined to the front portion 11 by a short strip 18 of material. The crotch insert 16 is separated from the material during the cutting operation. The curved sides preferrably correspond to the curvature of the cutouts.

Perforations 20 may be optionally provided at the juncture of the container strip 18 with the front panel at the same time or subsequent to the die-cut operation. As explained hereinafter, the container portion 17 will be detatched from the front panel and the use of perforations to facilitate a separation will depend upon the type of material used for the undergarment.

The preferred type of material used in making the undergarment is a thin, soft, light-weight non-woven paper or paper-like material such as cellulose rayon acetate, however, any other suitable, low cost disposable material may be used. Such materials would preferably have a sheer texture and fineness similar to hosiery or more expensive nylon panties. The undergarment according to the present invention may also be provided in various colors and designs may be incorporated into its surface by imprinting or other methods to provide a variety of attractive effects.

Material for the undergarment may be supplied in sheets or rolls. The material is die-cut in the substantially hourglass shape after being laid out on the sheet or roll. The crotch insert 16 is detached from the hourglass shape during the cutting operation. The crotch insert 16 is superimposed on the intermediate crotch portion 15 and sewn thereto along the top and bottom edges using a non-elastic thread. Thus, a double ply thickness is provided in the crotch area of the undergarment. It should be understood that the crotch insert 16 may also be glued, heat bonded, or otherwise suitably secured to the intermediate crotch portion 15, depending upon the material used.

The front and back portions 11 and 12 are sewn together at the sides 21 and 22 to provide vertical seams to form the body portion 23 having a waist portion 24. The preferred side seam is a made by superposing the side edges and stitching along the double ply using a non-elastic thread. The edges of the leg openings 13 and 14 including the side edges of the crotch insert 16 are folded over and sewn along the fold with an elastic thread or rubber band elastic in the stretched condition to form a stretchable elastic hem 25 about the leg openings. Similarly, the top edge of the waist portion 24 is folded over and sewn along the fold with an elastic thread or rubber band elastic in the stretched condition to form a stretchable elastic hem or waist band 26. The double plys at the hems and waist band and the quadruple ply at the sides of the crotch area reinforce the material at the critical areas.

The vertical side seams may be modified to provide an even less expensive undergarment by gluing the sides of the front and back portions together or by overlapping and securing them together with adhesive strips or tabs rather than sewing them together. It should be understood that they may also be heat bonded, or otherwise secured depending upon the material used.

The container portion 17, still attached to the body portion 23, is stitched just inwardly of its outer peripheral edge in a circular pattern as shown at 27 using an elastic thread or rubber band elastic in the stretched condition. After sewing, the leg opening hems 25 and the waist band 26 portion resume a relaxed state due to the elastic thread or rubber band elastic and the material is pulled together forming many tiny pleats. The container portion 17 now forms a small bag or pouch still attached to the body portion 23. The elastic stitching in the container draws together forming a stretchable elastic opening 28 at the top.

Figure 4:
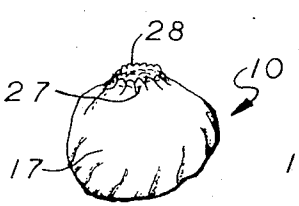
FIG. 4 is a perspective view of the garment of FIG. 1 stored in its container pouch.
Figure 5:
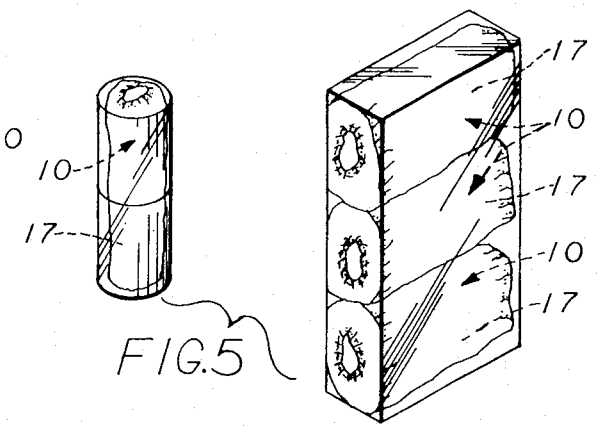
FIG. 5 is an isometric view of the disposable undergarment rolled and placed in packages.

The undergarment can then be folded or rolled into a small ball shape and inserted into the container pouch 17 as shown in FIG. 4. The opening 28 may also be sealed with a stick on label. As shown in FIG. 5, the rolled undergarments may be sold to the consumer in packages containing a plurality of the small pouches. The small pouches fit in a very small space, and a relatively large supply may be easily and conveniently carried in a purse, pocket, or suitcase. When the consumer desires to wear the undergarment, the pouch 17 is detached from the body portion 23 by separating at the perforations. The wearer may then carry the small container pouch 17 in the purse or pocket. After use, the undergarment may again be rolled into the small ball shape and inserted into the pouch 17 and disposed of.

The undergarment according to the present invention is suitable for every day use and particularly useful when vacationing or traveling. The undergarments may be packaged in very small containers (FIG. 5) suitable for use in vending machines in airports and restrooms, etc. For example, one pair could be rolled and placed inside a tubular lipstick type package, three pairs could be placed in a package the size of a king size cigarette pack, and a dozen pairs could be placed in a package the size of a one pound package of butter.

While this invention has been described fully and completely with special emphasis upon a preferred embodiment, it should be understood that within the scope of the appended claims the invention may be practiced otherwise than as specifically described herein.

I claim:

1. A disposable undergarment formed of a single sheet of non-woven cellulose material such as paper;

said sheet cut into a generally hourglass shape defining a front portion, a back portion, an intermediate crotch portion therebetween, two generally semi-circular opposed cut-outs situated on each side of the longitudinal center line of said sheet, a generally rectangular crotch insert portion secured to said intermediate crotch portion in superposed relation forming a double ply crotch area, and a pouch member within one of said opposed cut-outs and detachably adjoined to the hour-glass shape, said front and back portions secured together at their sides to form a main body portion having a pair of leg openings and a waist portion at the top thereof, the outer edges of said leg openings and the side edges of said crotch insert folded over and sewn along the fold with a thread or band of elastomeric material in the stretched condition to form a stretchable elastic hem about said leg openings, the top edge of said waist portion folded over and sewn along the fold with a thread or band of elastomeric material in the stretched condition to form a stretchable elastic waist band hem, said pouch member stitched just inwardly of its outer peripheral edge in a circular pattern with a thread or band of elastomeric material in the stretched condition to form a pouch having a stretchable elastic opening at the top, and capable of receiving and surrounding the undergarment in a rolled or folded condition, said pouch member capable of being detached from the undergarment prior to use by the wearer for receiving and storing the undergarment in a rolled or folded condit-ion after being worn, and disposed of at the convenience of the wearer.

2. A disposable undergarment according to claim 1 wherein said generally rectangular crotch insert portion has two curved sides corresponding to the curvature of said cutouts.

3. A disposable undergarment according to claim 1 wherein said crotch insert portion is secured at two ends by non-elastic thread to said intermediate crotch portion in superposed relation forming a double ply crotch area.

4. A disposable undergarment according to claim 1 wherein said crotch insert portion is secured by heat bonding to said intermediate crotch portion in superposed relation forming a double ply crotch area.

5. A disposable undergarment according to claim 1 wherein said material used in making the undergarment comprises thin, soft, light-weight cellullose rayon acetate.

6. A disposable undergarment according to claim 1 wherein said material used in making the undergarment has designs imprinted into its surface.

7. A disposable undergarment according to claim 1 wherein said front and back portions secured together at their sides by superposing the side edges and sewing the double ply with non-elastic thread to form vertical side seams extending from the waist portion to the leg openings.

8. A disposable undergarment according to claim 1 wherein said front and back portions secured together at their sides by superposing the side edges and heat bonding the double ply to form vertical side seams extending from the waist portion to the leg openings.

9. A disposable undergarment according to claim 1 wherein said front and back portions secured together at their sides by superposing the side edges and gluing the double ply to form vertical side seams extending from the waist portion to the leg openings.

10. A disposable undergarment according to claim 1 wherein said front and back portions secured together at their sides by superposing the side edges and securing them with adhesive strips.

11. A disposable undergarment according to claim 1 wherein said pouch when containing the stored undergarment is of sufficient size to be received with one or more like pouches within a small container of size suitable for use in vending machines.

12. A disposable undergarment according to claim 1 wherein a series of perforations are provided at the point of adjoinment of said pouch member portion to said hour-glass shape to facilitate removal therefrom.

13. A method of manufacturing a disposable undergarment formed of a single sheet of non-woven paper-like material comprising the steps of;

providing a single sheet of non-woven cellulose material such as paper, cutting said sheet into a generally hour-glass shape defining a front portion, a back portion, an intermediate crotch portion therebetween, two generally semi-circular opposed cut-outs situated on each side of the longitudinal center line of said sheet, a generally rectangular crotch insert portion within one of said opposed cut-outs, and a circular pouch member portion within one of said opposed cut-outs detachably adjoined to the hour-glass shape, superposing and securing said crotch insert portion on said intermediate crotch portion to form a double ply crotch area, superposing and securing the side edges of said front and back portions and securing the superposed side edges together to form a main body portion having a pair of leg openings and a waist portion at the top thereof, folding the outer edges of said leg openings and the side edges of said crotch insert over and sewing along the fold with thread or band of elastomeric material in the stretched condition to form a stretchable elastic hem about said leg openings, folding the top edge of said waist portion over and sewing along the fold with thread or band of elastomeric material in the stretched condition to form a stretchable elastic waist band hem, stitching said circular pouch member portion just inwardly of its outer peripheral edge in a circular pattern with a thread or band of elastomeric material in the stretched condition to form a pouch having a stretchable elastic opening at the top, and rolling or folding said undergarment and inserting it into said pouch, said pouch capable of being detached from the undergarment prior to use by the wearer for receiving and storing the undergarment in a rolled or folded condition after being worn, and disposed of at the convenience of the wearer.

14. A sheet of material suitable for use in making a disposable undergarment comprising:

a single sheet of non-woven cellulose material such as paper cut into a generally hour-glass shape defining a front portion, a back portion, an intermediate crotch portion therebetween, two generally semi-circular opposed cut-outs situated on each side of the longitudinal center line of said material, a generally rectangular crotch insert portion formed within one of said opposed cut-outs, and a circular pouch member portion formed within one of said opposed cut-outs and detachably adjoined to the hour-glass shape.

* * * * *